US011627797B2

(12) United States Patent
McManaman

(10) Patent No.: US 11,627,797 B2
(45) Date of Patent: Apr. 18, 2023

(54) BRUSH FOR CLEANING LAPS OF SIDING

(71) Applicant: Tim McManaman, Normal, IL (US)

(72) Inventor: Tim McManaman, Normal, IL (US)

( * ) Notice: Subject to any disclaimer, the term of this patent is extended or adjusted under 35 U.S.C. 154(b) by 0 days.

(21) Appl. No.: 16/243,937

(22) Filed: Jan. 9, 2019

(65) Prior Publication Data

US 2020/0214436 A1 Jul. 9, 2020

(51) Int. Cl.

| | |
|---|---|
| ***A47L 13/16*** | (2006.01) |
| ***A46B 9/02*** | (2006.01) |
| *A47L 13/10* | (2006.01) |

(52) U.S. Cl.

CPC ..... *A46B 9/025* (2013.01); *A46B 2200/3073* (2013.01); *A47L 13/10* (2013.01)

(58) Field of Classification Search

CPC ..... A47L 13/10; A46B 9/028; A46B 9/02; B08B 1/001; B08B 1/002

See application file for complete search history.

(56) References Cited

U.S. PATENT DOCUMENTS

| | | | | |
|---|---|---|---|---|
| 3,713,744 A * | 1/1973 | Sims | ..... | A47L 13/22 401/9 |
| 2004/0064909 A1* | 4/2004 | Locklear | ..... | A46B 5/0058 15/160 |
| 2018/0297086 A1* | 10/2018 | McManaman | ..... | B08B 1/04 |

* cited by examiner

*Primary Examiner* — Shay Karls

(57) ABSTRACT

A cleaning brush for cleaning laps of siding featuring a brush base with brush elements attached to the back and top surfaces of the brush base formed to compliment a lap of siding. The cleaning brush further comprises a four direction swivel mean attached to the brush base for engaging a handle wherein the cleaning brush can be extended to various heights to engage laps of siding. When in use, the cleaning brush comes in contact with a lap of siding and is slid laterally across a lap of siding removing debris from the siding.

12 Claims, 5 Drawing Sheets

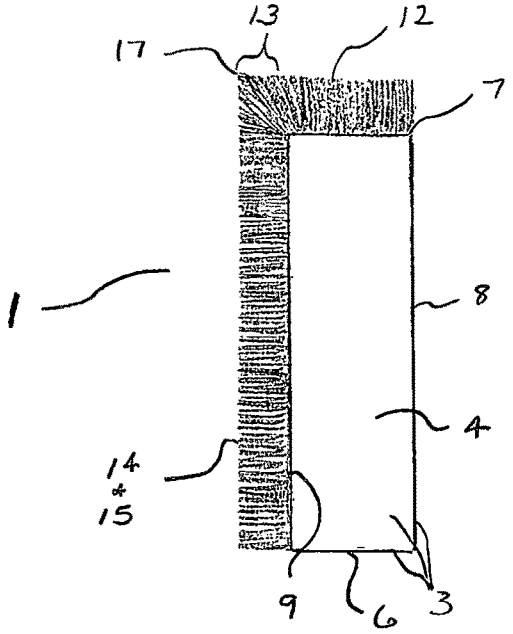
FIG. 3
FIG. 4
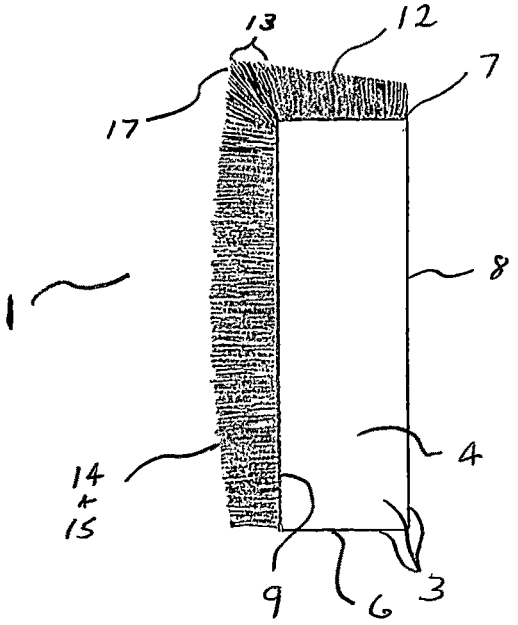
FIG. 5
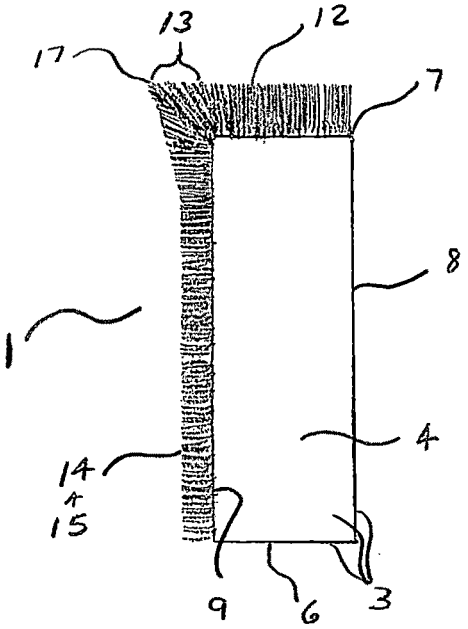

BRUSH FOR CLEANING LAPS OF SIDING

CROSS-REFERENCE TO RELATED APPLICATIONS

Not applicable.

BACKGROUND OF THE INVENTION

Field of the invention: The present invention relates generally to cleaning brushes, and more particularly to a cleaning brush for cleaning laps of siding.

Description of related art: Laps of siding involve long, even, horizontal rows of siding, referred to as laps, each lap having a side surface, an under surface and an interior corner surface connecting the side surface and the under surface. The side surfaces are thicker on the bottom than they are on the top, whereas a horizontal row of siding overlaps and connects to the row of siding directly below, creating a waterfall effect for the exterior side walls of a housing structure, keeping elements out.

Mold, mildew, and algae grow on areas of laps of siding which have no or limited direct sunlight and particularly grow on the under surfaces and interior corner surfaces of siding which are even more limited from direct sunlight. Dust, dirt, and pollen also attach to laps of siding on side surfaces, under surfaces and interior corner surfaces, collectively creating debris which creates a soiled and undesirable appearance for a housing structure. It is important when cleaning laps of siding that all mold, mildew and algae are thoroughly removed from the laps of siding, particularly form the more difficult under surfaces and interior corner surfaces, to avoid rapid regrowth of mold, mildew and algae.

Prior to the present invention, one of the most common methods of cleaning laps of siding was with the use of a power washer which spays pressurized water onto the laps of siding. Laps of siding are designed with a waterfall effect and therefore repel water as it falls from the sky. Laps of siding are not designed to receive water from the horizontal or bottom sides of the laps of siding. Such receipt of water from the horizontal or bottom sides can allow water to penetrate the laps of siding and create trapped water between the laps of siding and the understructure. This trapping of water can further damage the housing structure. Additionally, power washing laps of siding does not provide an abrasive scrubbing action and may not thoroughly remove debris from under surfaces of laps of siding.

Another prior method of cleaning laps of siding was with the use of a scrubber with soft fabric or foam scrubbing elements attached to a scrubbing base. These soft fabric or foam scrubbers do not provide the necessary abrasive scrubbing action to thoroughly remove debris from laps of siding and do not provide a stiff enough cleaning edge to remove debris from the interior corner surfaces of laps of siding. They also collect debris and need to be rinsed often when in use. Due to the limited abrasive scrubbing action of these scrubbers, they often need chemical cleaners applied to the scrubbers or to the laps of siding for successful debris removal.

Another prior method of cleaning laps of siding was with the use of cleaning chemicals applied directly to the laps of siding and rinsed with a garden hose. Since the under surfaces of laps of siding are generally ninety degrees horizontally adjacent to the side surfaces, cleaning chemicals are difficult to apply and stay in contact with under surfaces of laps of siding. Additionally, use of cleaning chemicals has to be handled with care and can harm plants, vegetation and pets.

BRIEF SUMMARY OF THE INVENTION

In view of the disadvantages inherent in the known types of cleaning apparatuses and methods of cleaning laps of siding, an object of the present invention is to provide a new cleaning brush for cleaning laps of siding.

It is another object of the present invention to provide a cleaning brush for cleaning laps of siding which is of a length to reach various heights of laps of siding common among housing structures. It is appreciated that a plurality of extension apparatuses can be adapted to provide a means for the cleaning brush to be extended to various heights.

A further object of the present invention is to provide a cleaning brush for cleaning laps of siding wherein the cleaning brush loosens and disperses debris when in use and does not collect debris within the cleaning brush and therefore does not require periodic rinsing.

Yet another object of the present invention is to provide a cleaning brush for cleaning laps of siding requiring no cleaning chemicals be applied to the brush or to laps of siding for effective use.

These and other objects of this invention shall become more apparent from the ensuing descriptions of the invention.

Accordingly, in general terms, a cleaning brush for cleaning laps of siding is disclosed comprising a brush base having a top surface, a bottom surface, a back surface, a front surface, a first side surface and a second side surface. The cleaning brush comprising a plurality of vertically and angularly radiating brush elements attached to the top surface of the brush base extending longitudinally from the first side surface to the second side surface, the brush elements of a stiffness to remove debris from under surfaces and interior corner surfaces of laps of siding without the presence of cleaning chemicals, and the brush elements spatially positioned on the top surface to prevent debris from collecting in the brush elements when in use. The cleaning brush further comprising two vertical strips of brush elements attached to the back surface of the brush base extending vertically from the bottom surface to the top surface adjacent to the first side surface and second side surface radiating horizontally away from the back surface, the brush elements of a stiffness to remove debris from side surfaces of laps of siding without the presence of cleaning chemicals, and the brush elements spatially positioned on the back surface to prevent debris from collecting in the brush elements when in use. The cleaning brush also comprising a brush edge extending longitudinally the length of the angular radiating brush elements.

BRIEF DESCRIPTION OF THE SEVERAL VIEWS OF THE DRAWINGS

The novel features of the cleaning brush for cleaning laps of siding are set forth in the claims. The invention itself, as well as its features will be best understood by the reference to the detailed drawings and accompanying description. It is appreciated that these drawings show preferred embodiments of the invention, however, should not be considered limiting, wherein:

FIG. 3, FIG. 4 and FIG. 5 are side views of the cleaning brush showing some, but not all, variations of the configuration of the brush elements;

DETAILED DESCRIPTION OF THE INVENTION

Figure 1:
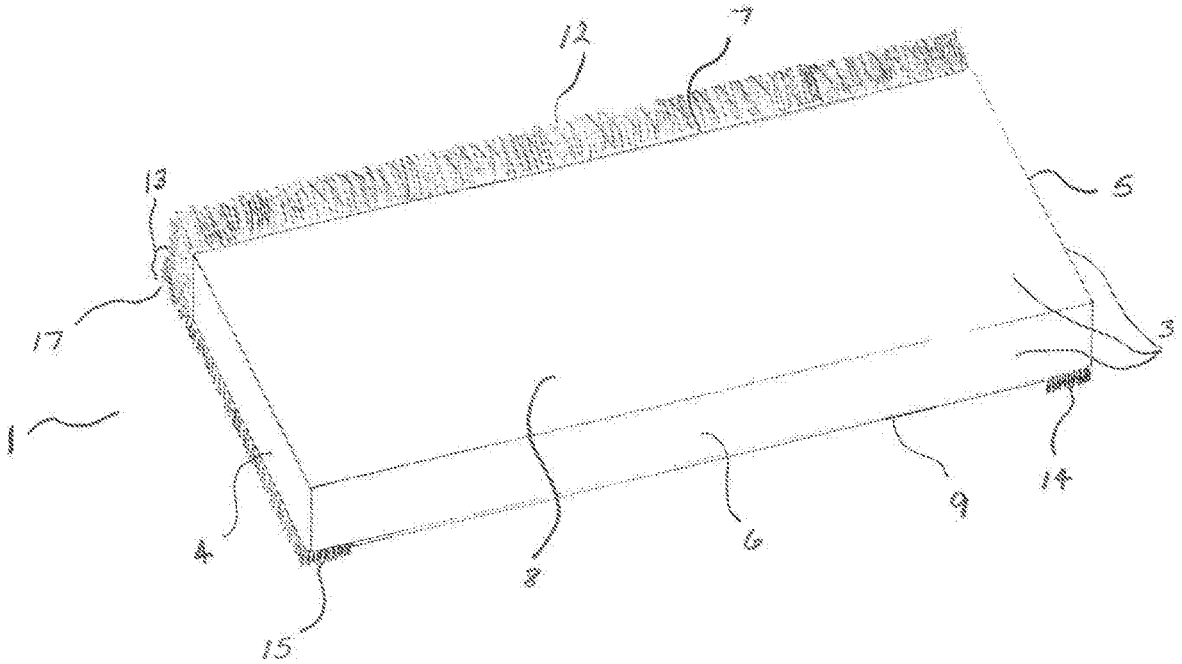
FIG. 1 shows a three dimensional back view of the cleaning brush according to one embodiment of this invention.

With reference to FIG. 1, a new cleaning brush for cleaning laps of siding, designated by the numeral 1, is described. The invention comprises a brush base 3, having a top surface 7, a bottom surface 6, a back surface 9, a front surface 8, a first side surface 4, and a second side surface 5. The brush base 3 comprised of a plurality of rigid materials such as wood, plastic or metal. The invention further comprising a plurality of vertically radiating brush elements 12 attached to the top surface 7 of the brush base 3 extending longitudinally from the first side surface 4 to the second side surface 5, the brush elements 12 of a stiffness to remove debris from under surfaces of laps of siding without the presence of cleaning chemicals, and the brush elements 12 spatially positioned on the top surface 7 to prevent debris from collecting in the vertically radiating brush elements 12 when in use. It is appreciated that there are a plurality of methods to attach brush elements 12 to the top surface 7 of the brush base 3. The invention further comprising a plurality of angular radiating brush elements 13 attached to the top surface 7 of the brush base 3 extending longitudinally from the first side surface 4 to the second side surface 5 and angled towards the back surface 9, the brush elements 13 of a stiffness to remove debris from under surfaces of laps of siding without the presence of cleaning chemicals, and the vertically radiating brush elements 13 spatially positioned on the top surface 7 to prevent debris from collecting in the vertically radiating brush elements 13 when in use. It is appreciated that there are a plurality of methods to attach angular radiating brush elements 13 to the top surface 7 of the brush base 3. The invention further comprising a first strip of brush elements 15 attached to the back surface 9 of the brush base 3 extending vertically from the bottom surface 6 to the top surface 7 adjacent to the first side surface 4 radiating generally perpendicular from the back surface 9, the first strip of brush elements 15 of a stiffness to remove debris from side surfaces of laps of siding without the presence of cleaning chemicals, and the first strip of brush elements 15 spatially positioned on the back surface 9 to prevent debris from collecting in the first strip of brush elements 15 when in use. The invention further comprising a second strip of brush elements 14 attached to the back surface 9 of the brush base 3 extending vertically from the bottom surface 6 to the top surface 7 adjacent to the second side surface 5 radiating generally perpendicular from the back surface 9, the second strip of brush elements 14 of a stiffness to remove debris from side surfaces of laps of siding without the presence of cleaning chemicals, and the second strip of brush elements 14 spatially positioned on the back surface 9 to prevent debris from collecting in the second strip of brush elements 14 when in use. The invention also comprising a brush edge 17 formed of the angular radiating brush elements 13 extending longitudinally the length of the angular radiating brush elements 13, the brush edge 17 is rigidly formed to remove debris from interior corner surfaces of laps of siding without the presence of cleaning chemicals. It is appreciated that there are a plurality of methods to attach the first strip of brush elements 15 and the second strip of brush elements 14 to the back surface 9. It is also appreciated that brush elements can be made from a plurality of materials such as nylon, polypropylene or horse hair.

Figure 2:
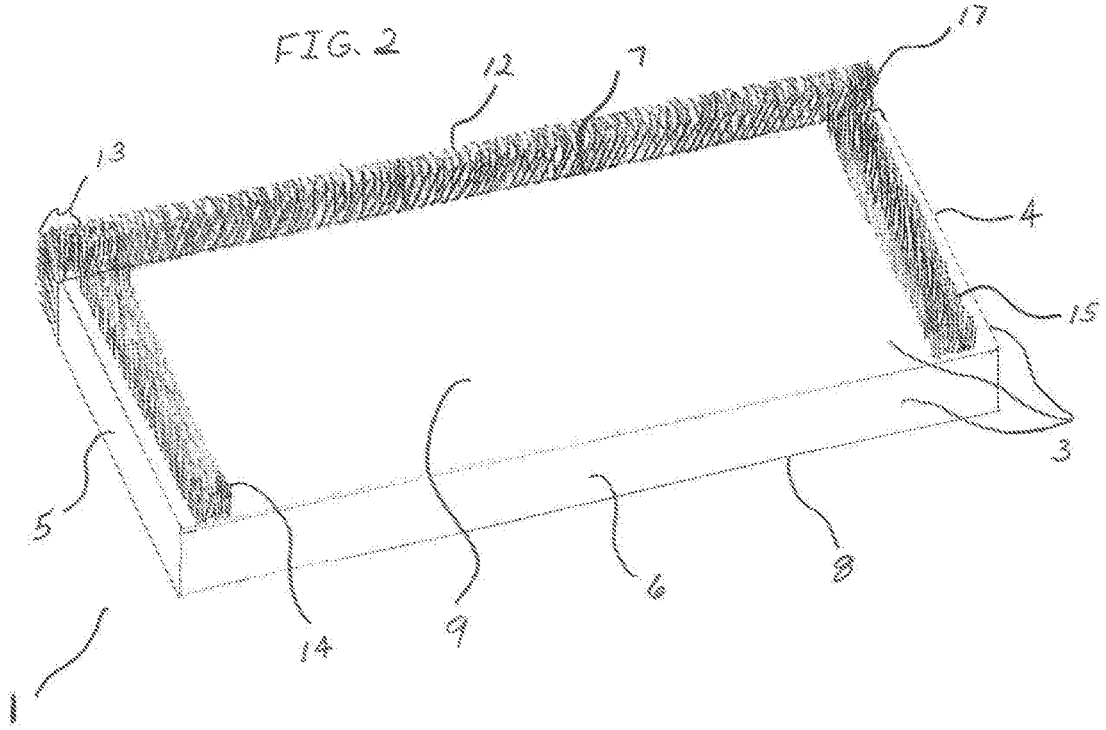
FIG. 2 shows a three dimensional front view of the brush according to one embodiment of this invention.

Referring to FIG. 2, the cleaning brush 1, is at a 180 degree rotation from FIG. 1 wherein the back surface 9 and the first strip of brush elements 15 and the second strip of brush elements 14 are more clearly shown.

Referring to FIG. 3, one embodiment of the cleaning brush 1 is shown with the end view of the brush base 3 rectangular in shape and the vertically radiating brush elements 12 are shown at a consistent height complimenting an under surface of a lap of siding. This embodiment also shows the first strip of bush elements 15 and the second strip of brush elements 14 consistent in height complimenting an under surface of a lap of siding. FIG. 3 further shows the angular radiating brush elements 13 and the brush edge 17 more clearly.

Referring to FIG. 4, another embodiment of the cleaning brush 1 is shown with the end view of the brush base 3 rectangular in shape and the vertically radiating brush elements 12 are shown wherein the radiating brush elements 12 increase in height from the front surface 8 to the back surface 9 to compliment an under surface of a lap of siding. This embodiment also shows the first strip of brush elements 15 and the second strip of brush elements 14 varying in height and forming a convex shape complimenting a side surface of a lap of siding.

Referring to FIG. 5, another embodiment of the cleaning brush 1 is shown with the end view of the brush base 3 rectangular in shape and the first strip of brush elements 15 and the second strip of brush elements 14 taper in height near the top surface 7 of the brush base 3, complimenting a side surface of a lap of siding.

Figure 6:
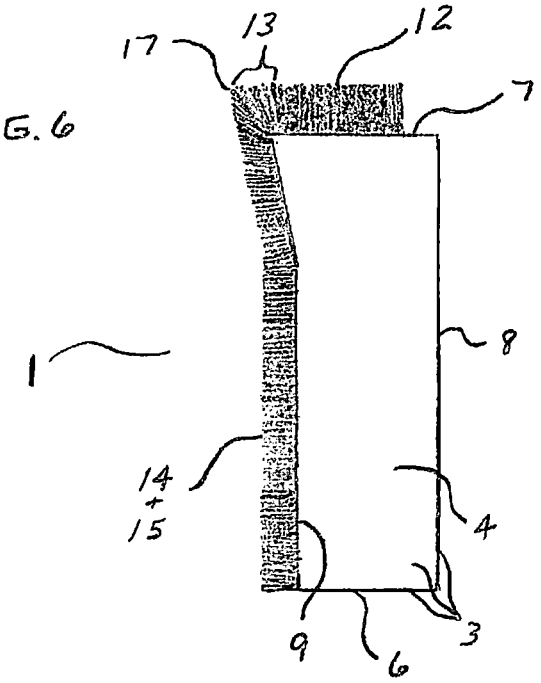
FIG. 6 and FIG. 7 are side views of the cleaning brush showing some, but not all, variations of the back surface of the brush.

Referring to FIG. 6, another embodiment of the cleaning brush 1 is shown with the end view of the brush base 3 wherein the back surface 9 of the brush base 3 is formed to compliment a side surface of a lap of siding and the first strip of bush elements 15 and the second strip of brush elements 14 are of a consistent height. It is appreciated that there are a plurality of shapes of side surfaces of laps of siding.

Figure 7:
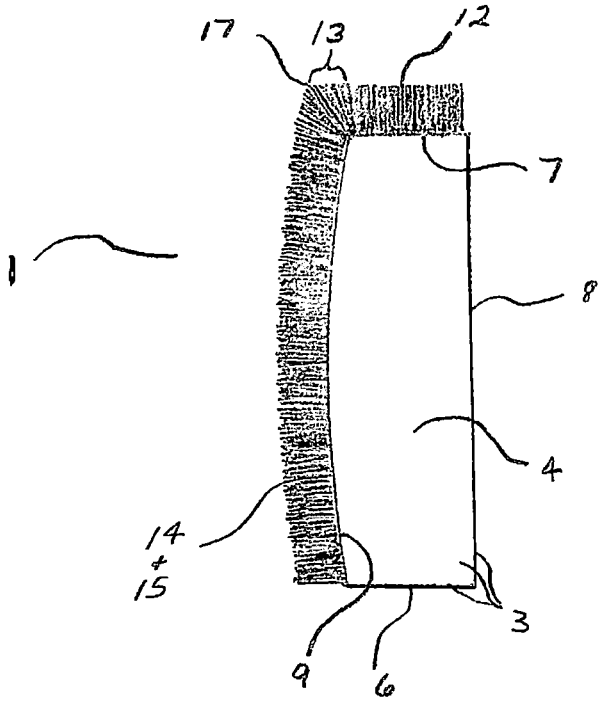

Referring to FIG. 7, another embodiment of the cleaning brush 1 is shown with the end view of the brush base 3 wherein the back surface 9 of the brush base 3 is formed to compliment another side surface of a lap of siding. It is appreciated that there are a plurality of shapes of side surfaces and under surfaces of rows of laps of siding based on manufacturing specifications.

Figure 8:
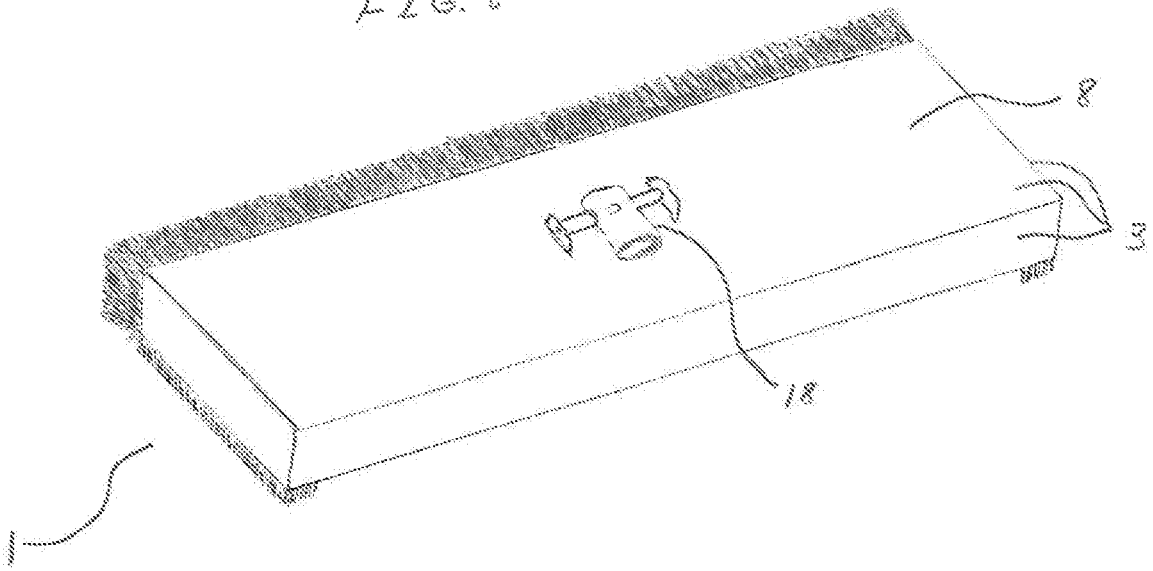
FIG. 8 is a three dimensional view of the cleaning brush showing a four direction swivel means attached to the front surface.

Referring to FIG. 8, the cleaning brush 1, is shown with a four direction swivel means 18 attached to the front surface 8 of the brush base 3 for engaging a handle. It is appreciated that there are a plurality of commercially available four direction swivel means 18 and a plurality of methods to attach the four direction swivel means 18 to the front surface 8 of the brush base 3.

Figure 9:
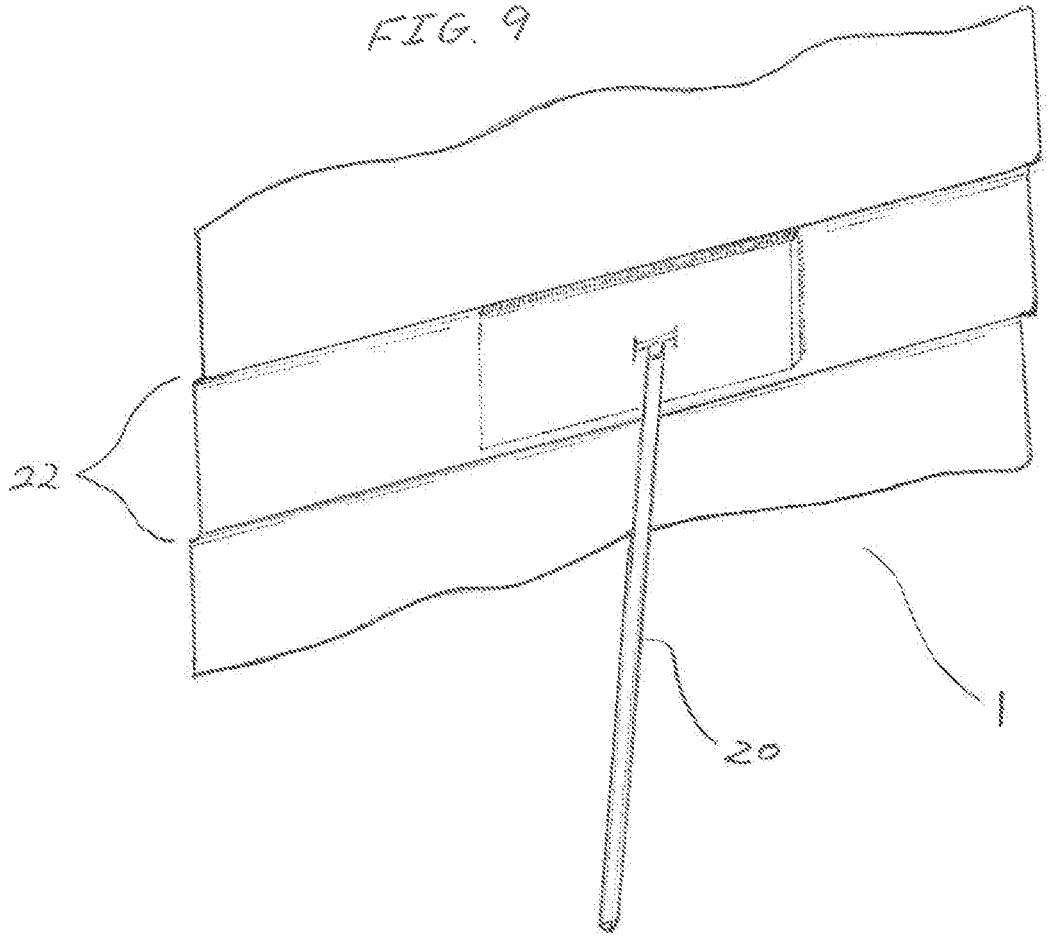
FIG. 9 shows an extension pole attached to the cleaning brush and the cleaning brush engaging a lap of siding.

Referring to FIG. 9, the cleaning brush 1 is shown attached to a handle 20 engaging a lap of siding 22.

Figure 10:
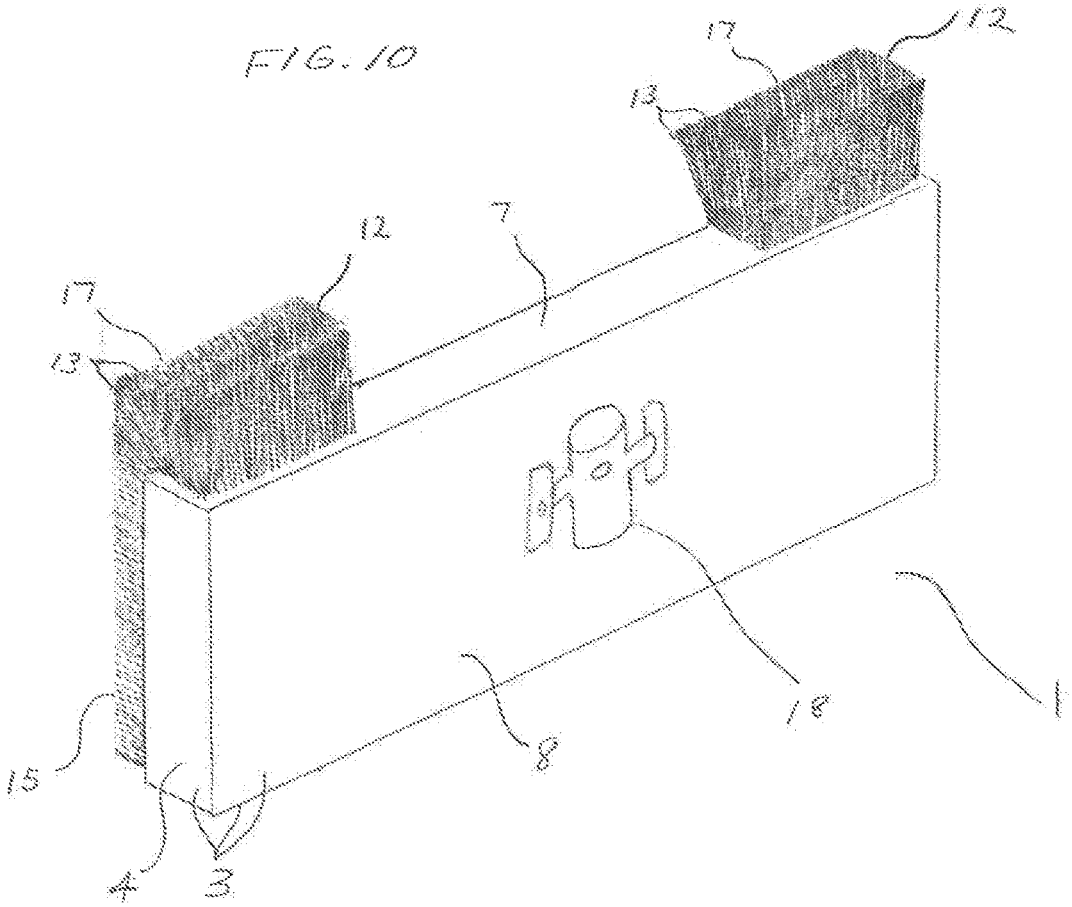
FIG. 10 shows a three dimensional view of the cleaning brush according to another embodiment of this invention.

Referring to FIG. 10, another embodiment of the cleaning brush 1 is shown wherein the vertically radiating brush elements 12 and the angular radiating brush elements 13 attach sectionally to the top surface 7 of the brush base 3.

Figure 11:
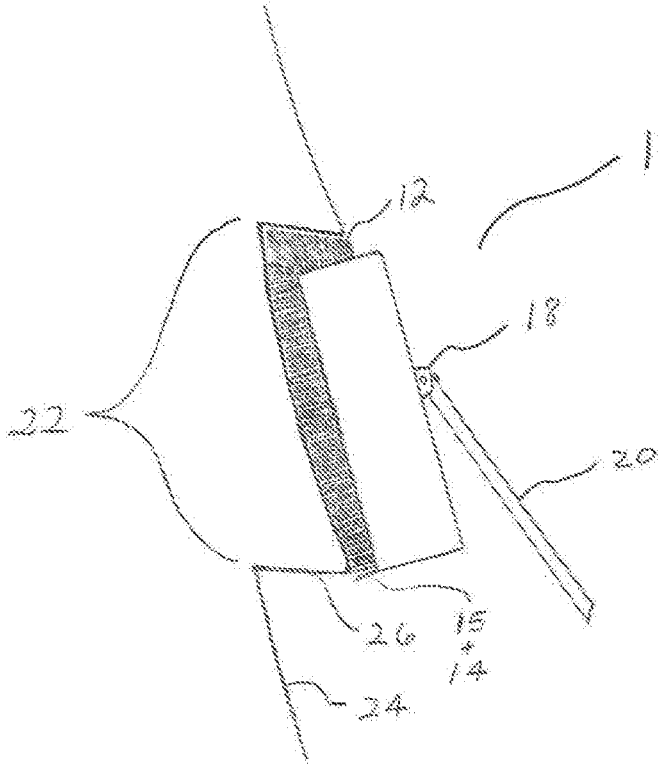
FIG. 11 is a side view of the cleaning brush attached to an extension pole engaging a lap of siding.

Referring to FIG. 11, the cleaning brush 1 is shown engaging a side surface 24 and an under surface 26 of a lap of siding 22. This embodiment of the cleaning brush 1 shows the vertically radiating brush elements 12 and the first strip of brush elements 15 and the second strip of brush elements 14 formed to compliment an under surface 26 and a side surface 24 of a lap of siding 22. This embodiment further shows the vertically radiating brush elements 12 forming an angular wedge wherein the cleaning brush 1 will remain engaged with a lap of siding 22 when an upward and horizontal force is placed upon the cleaning brush 1 when in use. To appreciate this feature, it is understood that the cleaning brush 1 is slid laterally across a lap of siding 22 and an upward and lateral force is required to effectively remove debris. Additionally, a light application of water may be applied to the lap of siding 22 prior to using the cleaning brush 1, and a light application of water may be applied to the lap of siding 22 after using the cleaning brush 1 for rinsing debris from the lap of siding 22.

The invention claimed is:

1. A cleaning brush for cleaning laps of siding comprising:

a. a brush base having a top surface, a bottom surface, a back surface, a front surface, a first side surface and a second side surface;

b. a plurality of vertically radiating brush elements attached to the top surface of the brush base extending longitudinally from the first side surface to the second side surface, the brush elements of a stiffness to remove debris from under surfaces of laps of siding without the presence of cleaning chemicals, and the brush elements spatially positioned on the top surface to prevent debris from collecting in the brush elements when in use;

c. a plurality of angular radiating brush elements attached to the top surface of the brush base extending longitudinally from the first side surface to the second side surface and angled towards the back surface, the brush elements of a stiffness to remove debris from under surfaces of laps of siding without the presence of cleaning chemicals, and the brush elements spatially positioned on the top surface to prevent debris from collecting in the brush elements when in use;

d. a first strip of brush elements attached to the back surface of the brush base extending vertically from the bottom surface to the top surface adjacent to the first side surface radiating perpendicular from the back surface, the brush elements of a stiffness to remove debris from side surfaces of laps of siding without the presence of cleaning chemicals, and the brush elements spatially positioned on the back surface to prevent debris from collecting in the brush elements when in use;

e. a second strip of brush elements attached to the back surface of the brush base extending vertically from the bottom surface to the top surface adjacent to the second side surface radiating perpendicular from the back surface, the brush elements of a stiffness to remove debris from side surfaces of laps of siding without the presence of cleaning chemicals, and the brush elements spatially positioned on the back surface to prevent debris from collecting in the brush elements when in use;

f. a brush edge formed of the angular radiating brush elements and extending longitudinally the length of the angular radiating brush elements, the brush edge to remove debris from interior corner surfaces of laps of siding without the presence of cleaning chemicals.

2. The cleaning brush of claim 1 wherein a plurality of the vertically radiating brush elements attach to sections of the top surface of the brush base.

3. The cleaning brush of claim 1 wherein a plurality of the angular radiating brush elements attach to sections of the top surface of the brush base.

4. The cleaning brush of claim 1 wherein the brush base is made of a plurality of rigid materials such as wood or plastic.

5. The cleaning brush of claim 1 wherein the first strip of brush elements is formed to compliment a side surface of a lap of siding.

6. The cleaning brush of claim 1 wherein the second strip of brush elements is formed to compliment a side surface of a lap of siding.

7. The cleaning brush of claim 1 wherein a four direction swivel means is attached to the front surface of the brush base for engaging a handle.

8. The cleaning brush of claim 1 wherein a four direction swivel means is attached to the front surface of the brush base for engaging a telescopically adjustable handle.

9. The cleaning brush of claim 1 wherein the brush elements attached to the back surface vary in height to compliment a side surface of a lap of siding.

10. The cleaning brush of claim 1 wherein the brush elements attached to the top surface vary in height to compliment an under surface of a lap of siding.

11. The cleaning brush of claim 1 wherein the back surface is shaped to compliment a side surface of a lap of siding.

12. The cleaning brush of claim 1 wherein the brush elements are made from a plurality of materials such as nylon, polypropylene or horse hair.

* * * * *